US010047920B2

(12) United States Patent
Uke

(10) Patent No.: US 10,047,920 B2
(45) Date of Patent: Aug. 14, 2018

(54) FLASHLIGHT EMITTING LIGHT IN TWO DIFFERENT DIRECTIONS USING A REFLECTOR AND REFLECTIVE SURFACE

(71) Applicant: Alan K. Uke, Del Mar, CA (US)

(72) Inventor: Alan K. Uke, Del Mar, CA (US)

( * ) Notice: Subject to any disclaimer, the term of this patent is extended or adjusted under 35 U.S.C. 154(b) by 159 days.

(21) Appl. No.: 15/142,196

(22) Filed: Apr. 29, 2016

(65) Prior Publication Data

US 2017/0314746 A1 Nov. 2, 2017

(51) Int. Cl.

| | |
|---|---|
| ***F21L 4/00*** | (2006.01) |
| ***F21V 7/00*** | (2006.01) |
| ***F21V 5/04*** | (2006.01) |
| ***F21V 5/00*** | (2018.01) |
| *F21V 14/08* | (2006.01) |
| *F21V 11/08* | (2006.01) |
| *F21Y 101/00* | (2016.01) |
| *F21Y 115/10* | (2016.01) |

(52) U.S. Cl.

CPC ..... *F21L 4/005* (2013.01); *F21V 5/006* (2013.01); *F21V 5/04* (2013.01); *F21V 7/0091* (2013.01); *F21V 11/08* (2013.01); *F21V 14/085* (2013.01); *F21Y 2101/00* (2013.01); *F21Y 2115/10* (2016.08)

(58) Field of Classification Search

CPC . F21L 4/005; F21L 4/022; F21L 4/025; F21L 4/027; F21V 14/045; F21V 14/065; F21V 5/006; F21V 7/0075; F21V 7/0025; F21V 7/0033

See application file for complete search history.

(56) References Cited

U.S. PATENT DOCUMENTS

| | | | | |
|---|---|---|---|---|
| 6,158,874 A * | 12/2000 | Brustein | F21L 4/022 | 362/184 |
| 6,598,993 B1 * | 7/2003 | Dalton | F21L 4/005 | 362/188 |
| 9,222,642 B2 * | 12/2015 | Hsu | F21V 5/006 | |
| 9,651,208 B2 * | 5/2017 | Sharrah | F21L 4/08 | |
| 2007/0097676 A1 * | 5/2007 | Chien | F21L 4/027 | 362/202 |

* cited by examiner

*Primary Examiner* — Robert May

(74) *Attorney, Agent, or Firm* — David M. Breiner; BrownWinick Law Firm

(57) ABSTRACT

Disclosed is a flashlight which may include of a first window arranged at a first end of the flashlight, a light source configured to generate light, a first reflector configured to reflect light from the light source to the first window to generate a first beam of light, and a second reflector configured to reflect stray light from the light source through one of a first aperture and a first gap in the first reflector to generate a second beam of light leaving the flashlight through a second window.

19 Claims, 11 Drawing Sheets

FLASHLIGHT EMITTING LIGHT IN TWO DIFFERENT DIRECTIONS USING A REFLECTOR AND REFLECTIVE SURFACE

BACKGROUND

1. Field

Example embodiments relate to flashlights configured to form a downlight.

2. Description of the Prior Art

Conventional flashlights include a light source (for example, a light bulb or a light emitting diode) surrounded by a reflector configured to direct light out of the flashlight and into an environment. Generally, flashlights direct light in one direction only. While one directional illumination is normally acceptable, there are some situations in which two direction illumination is desired. For example, some flashlight users desire to have the ground beneath them illuminated while, at the same time, have an area in front of them illuminated. This problem has been solved by some flashlight makers who have incorporated a second light in the flashlight to shine a light in a downward direction while a first light shines light horizontally. This second light is typically referred to as a downlight.

SUMMARY

The inventor has noted that flashlights equipped with downlights generally have an acceptable performance, however, they also use energy at a significantly higher rate than standard flashlights. This increased power consumption depletes battery life of the flashlight. The inventor sought out to configure a flashlight with a downlight which does not suffer the above drawback and, as a result, has invented novel and nonobvious concepts useable with flashlights.

In accordance with a nonlimiting example of the invention, a flashlight may be comprised of a light source, a first window configured to allow light generated from the light source to leave the flashlight in a first direction, and a second window configured to allow light generated from the light source to leave the flashlight in a second direction.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
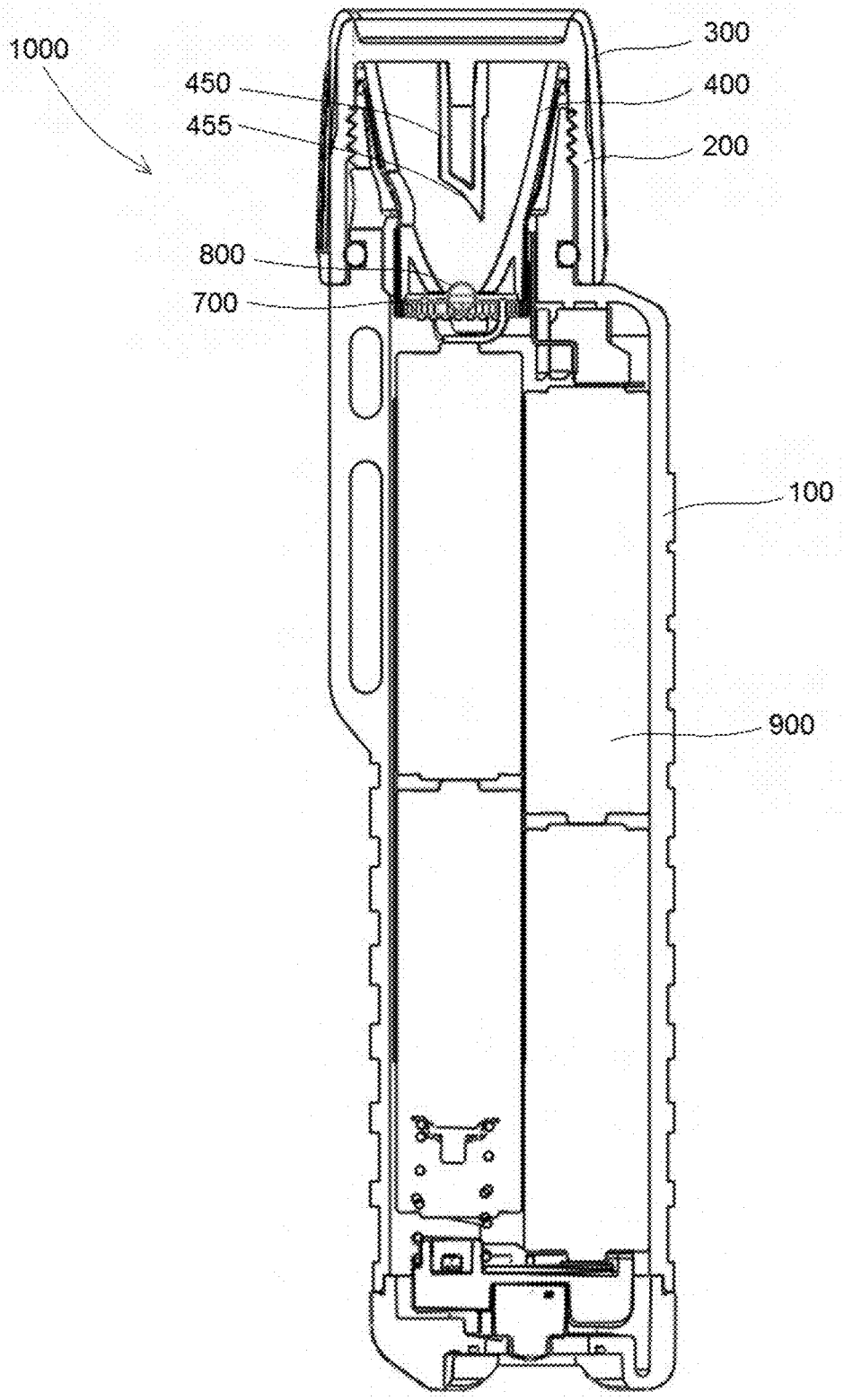
FIG. 1 is a cross-section view of a flashlight in accordance with example embodiments.

Example embodiments will now be described more fully with reference to the accompanying drawings, in which example embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on," "connected to," or "coupled to" another element or layer, it can be directly on, connected to, or coupled to the other element or layer or intervening elements or layers that may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another elements, component, region, layer, and/or section. Thus, a first element component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to a flashlight configured to form a downlight.

FIG. 1 is a cross-section view of a flashlight 1000 in accordance with an example of the invention. As shown in FIG. 1, the flashlight 1000 includes a body 100, a bezel 200 arranged at an end of the body 100, and a shroud 300 over the bezel 200. As in the conventional art, the body 100 may enclose power sources 900 which may be, but are not required to be, dry cell batteries, along with various circuitry for transferring electricity from power sources 900 to a light source 800 which may be, but is not required to be, a light emitting diode and/or a light bulb. In the event the light source 800 is a light emitting diode, the flashlight 1000 may further include a printed circuit board 700 supporting the light emitting diode. Because the circuitry involved in routing power to the light source 800 is relatively common in the art, a detailed description thereof is omitted for the sake of brevity.

Figure 2A:
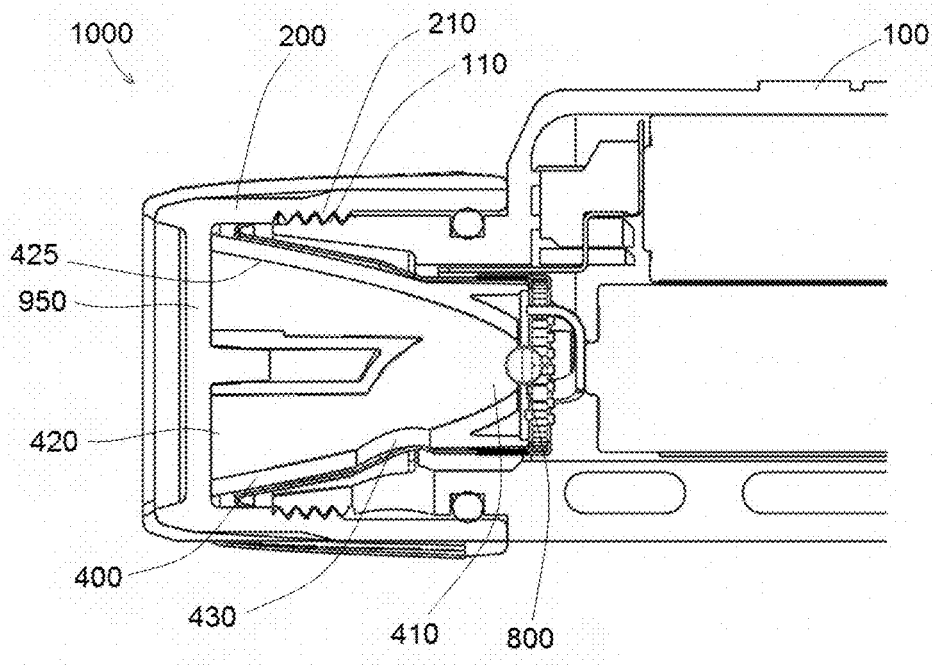
FIG. 2A is a cross-section-close-up view of an end of the flashlight in accordance with example embodiments.

Referring to FIG. 2A, which is a close-up view of an end of the flashlight 1000 illustrated in cross-section, it is observed the body 100 may have threads 110 configured to engage threads 210 of the bezel 200. This allows for the bezel 200 to screw onto an end of the body 100. This aspect of the disclosure, however, is not meant to limit the invention as the body 100 and the bezel 200 may attach to one another by an alternative means such as, but not limited to, pins, clips, brackets, braces and/or adhesives, provided the head of the flashlight can rotate if it is desired to shut off a downward beam of light.

As shown in FIG. 2A, the bezel 200 encloses a first reflector 400. The first reflector 400 may resemble a hollow truncated cone having curved sides, an open first end 410 and an open second end 420. The open first end 410 may be arranged near the light source 800 whereas the open second end 420 may be arranged near an end of the flash light 1000. The inside surface 425 of the first reflector 400 may be substantially reflective to reflect and direct light from the light source 800 out of the open second end 420 of the reflector 400 so the light may leave the flashlight 1000 via a first window 950 which may be comprised of a transparent material, such as plastic or glass. The first window 950 may, for example, resemble a transparent plastic or glass disc. In the alternative, the first window 950 may be integral with the bezel 200 which may be made of a transparent material. The particular shape of the first reflector 400 is generally not critical and may resemble a conventional reflector, however, unlike conventional reflectors, the first reflector 400 includes an aperture 430 or a gap which, as will be explained below, may allow some of the light generated by the light source 800 to leave the flashlight 1000 in a direction different from the light leaving the open second end 420 of the first reflector 400. The light passing through the aperture 430 or gap may be directed in a downward direction and thus, may serve as a downlight. This light originates from the light source 800 and is comprised of light which would not hit the surface 425 of the first reflector 400 (in this application, "stray light"). Because the light diverted downward is not light which would have hit the surface 425 of the first reflector 400, the strength of the beam from the surface 425 of the first reflector 400 remains unchanged except for the portion of light which falls directly from the light source 800 onto the aperture 430.

Figure 2B:
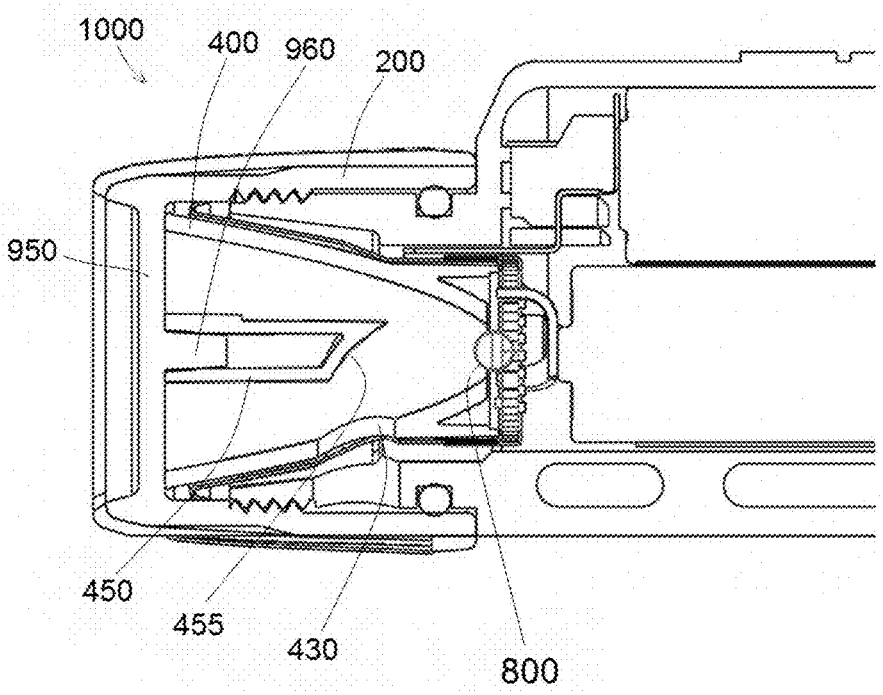
FIG. 2B is a cross-section-close-up view of an end of the flashlight in accordance with example embodiments.

Referring to FIG. 2B, the first window 950 may include, but is not required to include, a stub 960. The stub 960 may be formed integrally with the first window 950 or may be separately formed and then attached to the first window 950. The stub 950 may serve as an attachment structure for a second reflector 450. The second reflector 450 may have a reflective surface 455 which may be inclined, flat, and/or curved to concentrate at least some of the stray light and form a beam of light passing through the aperture 430 or gap. For example, in one nonlimiting example embodiment, the reflective surface 455 may resemble a concave surface configured to concentrate stray light from the light source 800 and direct the stray light from the light source 800 through the aperture 430 or gap of the first reflector 400. As another example, the reflective surface 455 may simply be an inclined flat surface configured to direct stray light from the light source 800 through the aperture 430 or gap.

The placement of the second reflector 450 may be at or near a centerline of the first reflector 400 in an area where light generated by the light source 800 would not hit the reflective surface 425 of the first reflector 400. As such, the second reflector 450 may not significantly diminish the beam intensity of the flashlight leaving the first window 950. That is, light coming directly off the light source 800, which would be stray light, which does not hit the first reflector 400, would be concentrated into a beam and deflected through the aperture 430 or gap of the first reflector 400.

Figure 3:
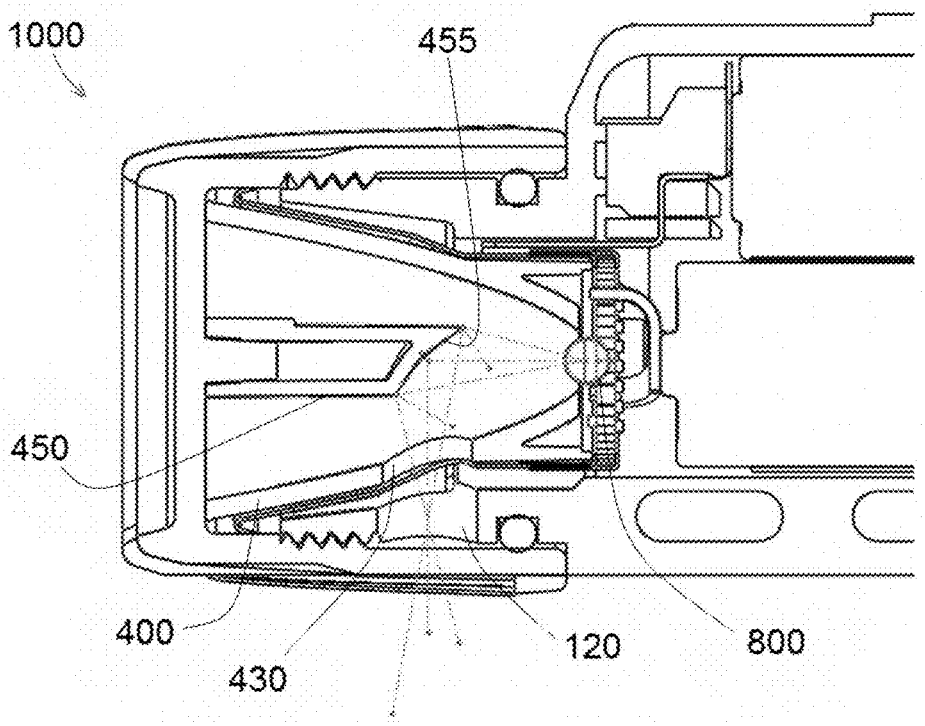
FIG. 3 is a cross-section-close-up view of an end of the flashlight in accordance with example embodiments wherein a light source is generating light reflected by a second reflector.
Figure 4:
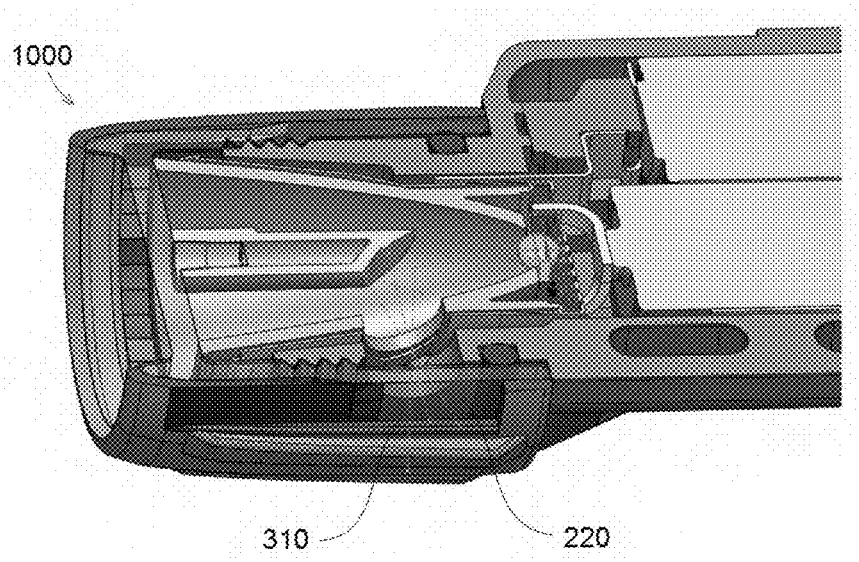
FIG. 4 is a perspective view of a cross-section-close-up view of an end of the flashlight in accordance with example embodiments wherein a light source is generating light reflected by a second reflector.
Figure 5:
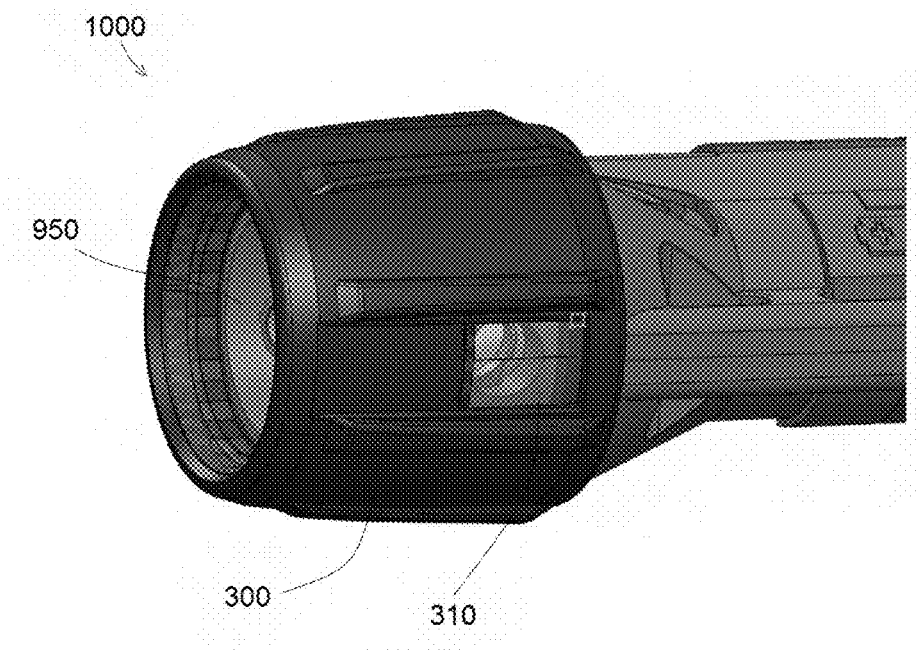
FIG. 5 is a view of an end of the flashlight in accordance with example embodiments.

FIG. 3 is close-up view of an end of the flashlight 1000 illustrated in cross-section with the light source 800 generating light. As shown in FIG. 3, some of the stray light generated by the light source 800 hits the reflective surface 455 of the second reflector 450 and is directed towards the aperture 430 or gap. This light may then pass through the aperture 430 or gap and through an aperture 120 or gap in the body 100. The bezel 200 may also include an aperture, window, or a gap 220 which may allow the light to pass through the bezel 200. On the other hand, the bezel 200 may be made from a transparent material which allows the light to pass therethrough without the need for an aperture or window. The shroud 300 may include a second window or aperture 310 (see FIG. 4) which may allow the light passing through the apertures 430, 120, and 220 to leave the flashlight 1000. The second window 310 may be an open space or may be comprise a transparent or semitransparent material built into the shroud 300. In example embodiments, the shroud 300 may be molded to protect the bezel from scratching. In example embodiments, a user may simply twist the shroud 300 to misalign the window 310 with the aperture 120 to either decrease the amount of light leaving through the window 310 or to prevent the light from leaving the flashlight 1000 via the second window 310.

In example embodiments, the second reflector 450 and the bezel 200 may be attached to one another so as to act as a substantially unitary member. In addition, the first reflector 400 may also be attached to the bezel 200 so that each of the first reflector 400, the bezel 200 and the second reflector 450 may act as a unitary member. Further yet, each of the first reflector 400, the second reflector 450, the bezel 200, and the shroud 300 may be attached to one another so that the first reflector 400, the second reflector 450, the bezel 200, and the shroud 300 act a unitary member. In this latter embodiment, the first reflector 400, the second reflector 450, the bezel 200, and the shroud 300 may be arranged so that the aperture 430 of the first reflector 400, the aperture 220 of the bezel 200 (assuming one is present, which is not necessary as the bezel 200 may be made from a transparent material) and the window 310 of the shroud 300 are aligned and the aperture 430 of the first reflector 400, the aperture 220 of the bezel 200, and the window 310 of the shroud 310 are arranged to receive light from the reflective surface 455 of the second reflector 450. In this latter embodiment, rotating the shroud 300 would rotate the bezel 200, the first reflector 400, and the second reflector 450 with respect to the body 100 allowing the aperture 430 of the first reflector 400, the aperture 220 of the bezel 200, and the window 310 of the shroud 310 to align or misalign with the aperture 120 of the body 100 to either allow or prevent light from leaving the shroud 300 through window 310.

The flashlight of example embodiments provides several advantages over the conventional art. For example, the second reflector 450 does not significantly increase the size or shape of a conventional flashlight. However, more importantly, the introduction of the second reflector 450, along with the inventor's further changes to the flashlight body 100, bezel 200, shroud 300, and reflector 400, allow for a downlight to be created without the need for a second light thereby eliminating the need for a second light as required in the conventional art. This, in turn, reduces power consumption observed in the conventional art flashlights having a downlight.

Figure 15A:
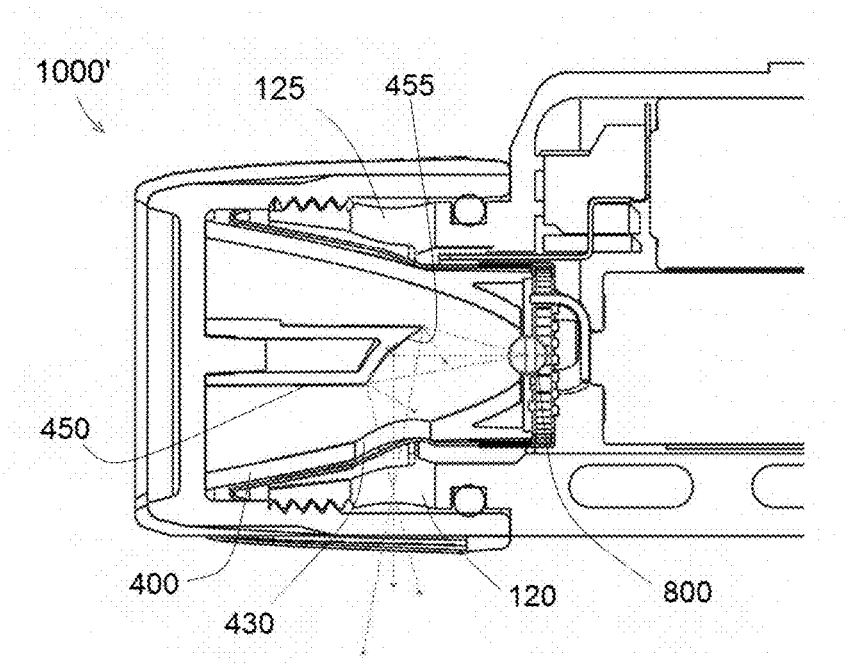
FIGS. 15A and 15B illustrate another example of a flashlight in accordance with example embodiments.
Figure 15B:
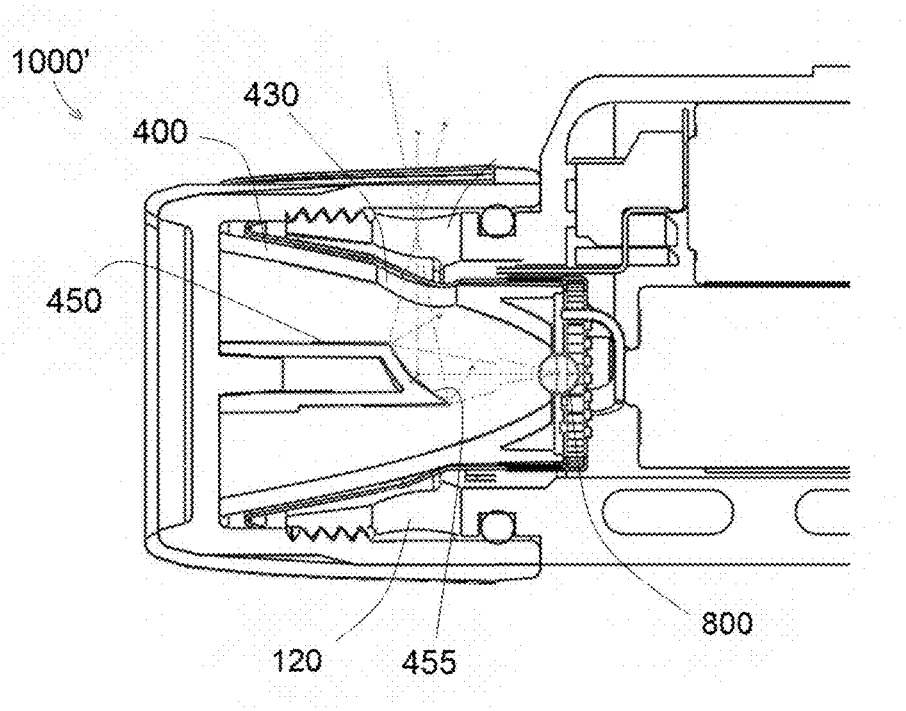

FIGS. 15A and 15B illustrate a modification to flashlight 1000. The flashlight 1000' of FIGS. 15A and 15 is substantially identical to the flashlight 1000 except that the flashlight 1000' has a body 100 having a second aperture 125. An advantage of the second aperture 125 is that a user may simply rotate the shroud 300 which in turn rotates the bezel 200, the first reflector 400, and the second reflector 450 to shine light upwards and out of the flashlight 1000' through the second aperture 125 thus forming an uplight (rather than a downlight) as shown in FIG. 15B. In fact, the body 100 of flashlight 1000' may be further modified with a plurality of apertures which may allow light to leave therethrough. Thus, flashlights of example embodiments may be configured with a downlight, an uplight, or side lights (if desired).

Figure 6:
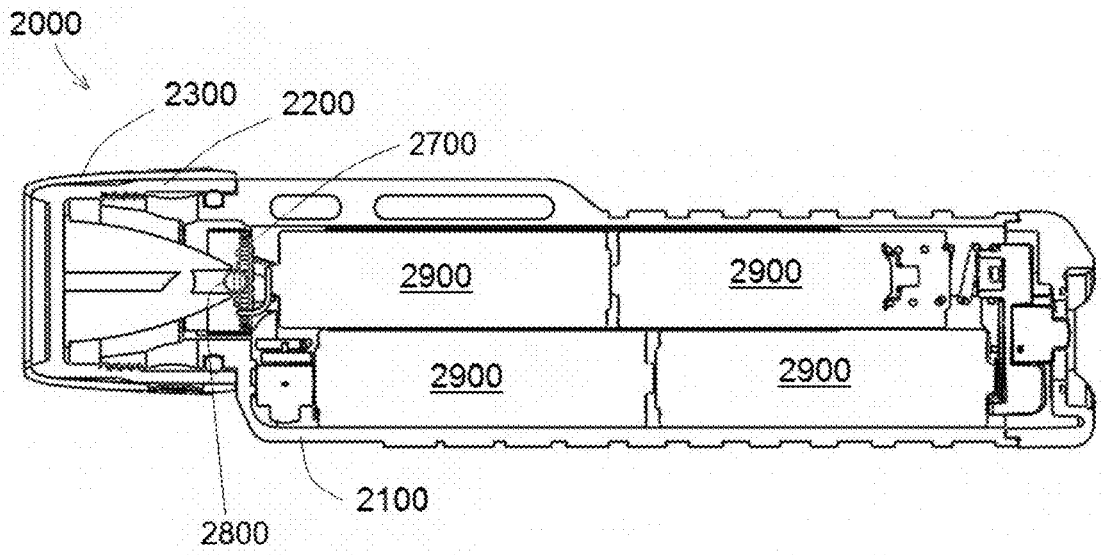
FIG. 6 is a cross-section view of a flashlight in accordance with example embodiments.

FIG. 6 is a cross-section view of a flashlight 2000 in accordance with another example of the invention. As shown in FIG. 6, the flashlight 2000 includes a body 2100, a bezel 2200 arranged at an end of the body 2100, and a shroud 2300 over the bezel 2200. As in the conventional art, the body 2100 may enclose power sources 2900 which may be, but are not required to be, dry cell batteries, along with various circuitry for transferring electricity from power sources 2900 to a light source 2800 which may be, but is not required to be, a light emitting diode and/or a light bulb. In the event the light source 2800 is a light emitting diode, the flashlight 2000 may further include a printed circuit board 2700 supporting the light emitting diode. Because the circuitry involved in routing power to the light source 2800 is relatively common in the art, a detailed description thereof is omitted for the sake of brevity.

Figure 7:
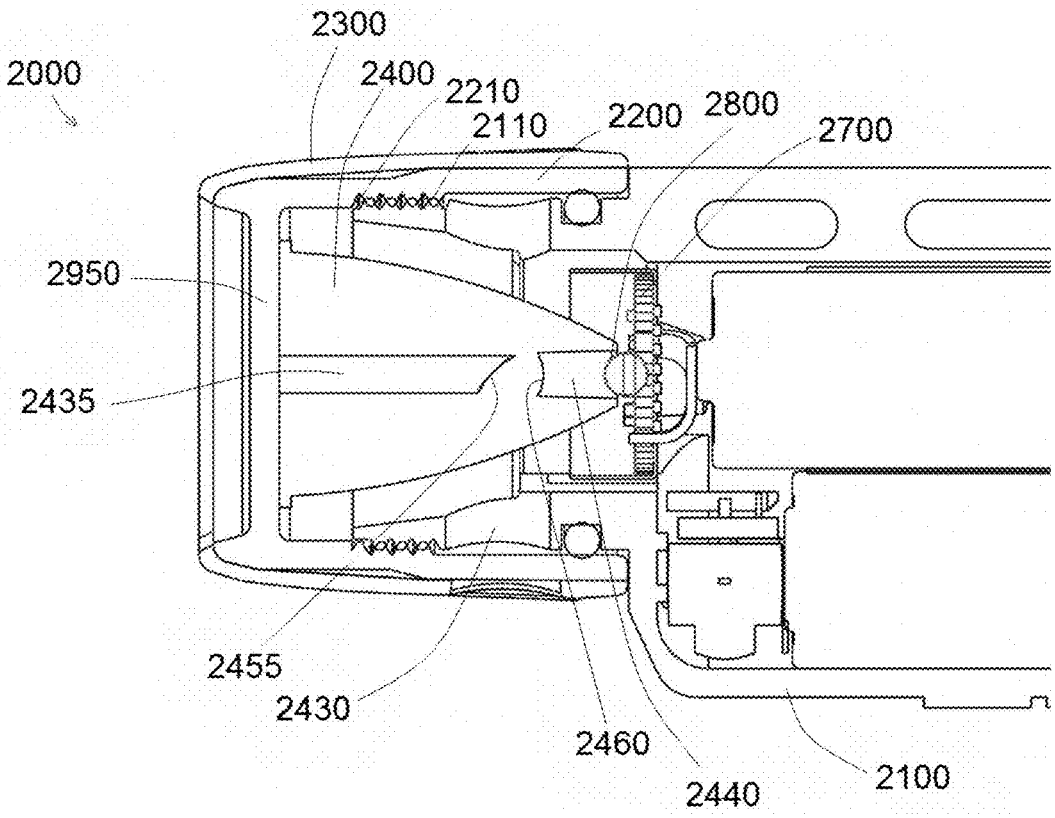
FIG. 7 is a cross-section close-up view of a flashlight in accordance with example embodiments.
Figure 8:
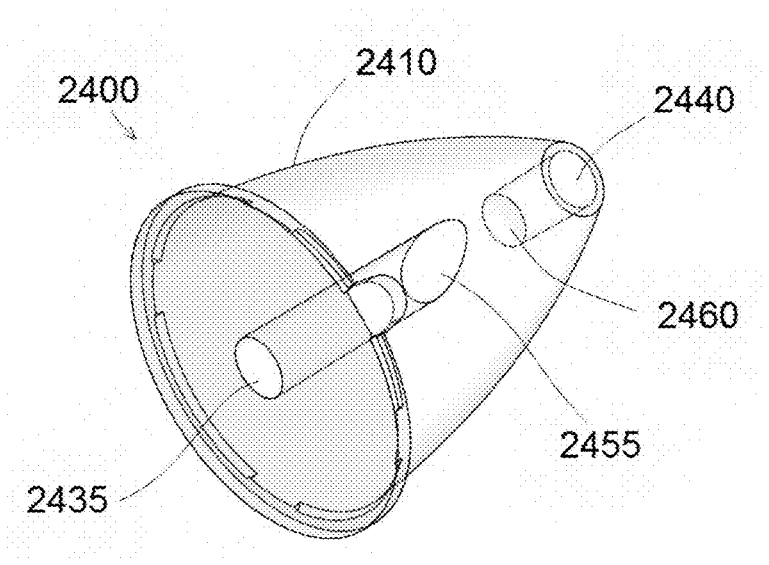
FIG. 8 is a view of a lens in accordance with example embodiments.

Referring to FIG. 7, which is a close-up view of an end of the flashlight 2000 illustrated in cross-section, it is observed the body 2100 may have threads 2110 configured to engage threads 2210 of the bezel 2200. This allows for the bezel 2200 to screw onto an end of the body 2100. This aspect of the disclosure, however, is not meant to limit the invention as the body 2100 and the bezel 2200 may attach to one another by an alternative means such as, but not limited to, pins, clips, brackets, braces and/or adhesives so long as the head of the flashlight 2000 may rotate with respect to the body 2100 if it is desired to shut off a downward beam of light.

Figure 9:
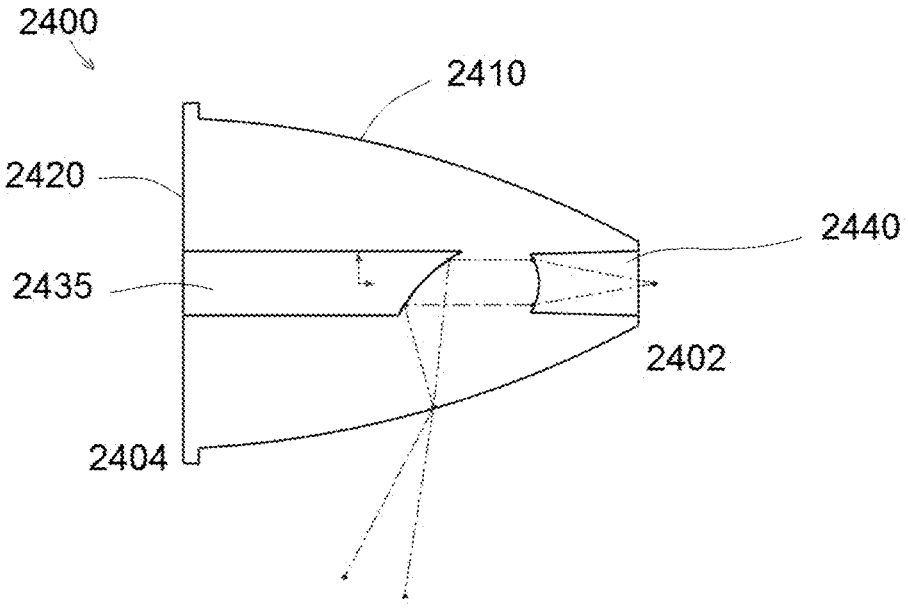
FIG. 9 is a cross-section view of the lens in accordance with example embodiments.
Figure 10:
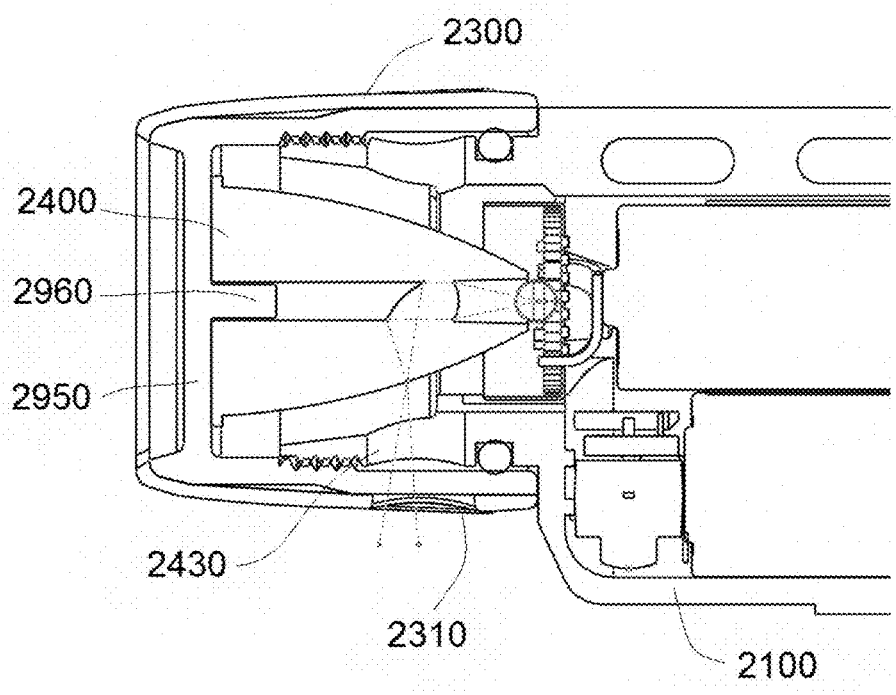
FIG. 10 is a close-up cross-section view of an end of a flashlight showing light generated by a light emitting device and reflected out of the flashlight.
Figure 11:
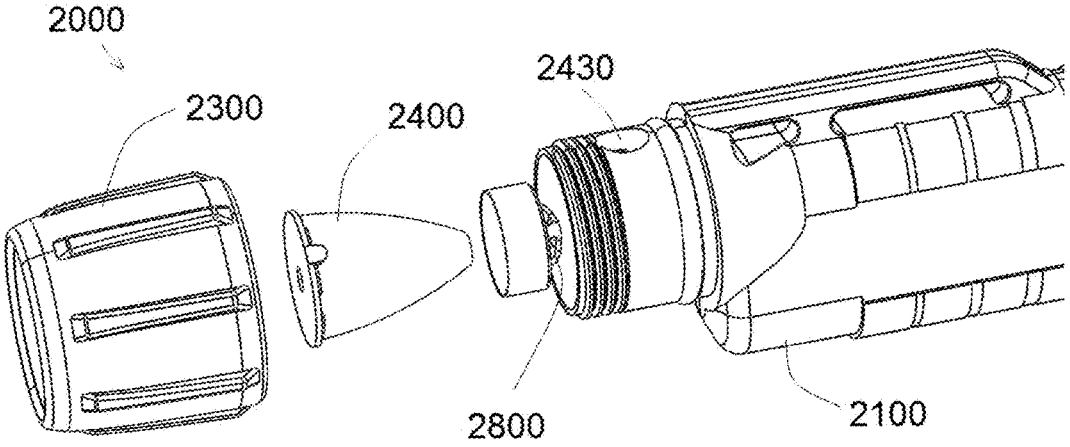
FIG. 11 is an exploded view of a flashlight in accordance with example embodiments.

As shown in FIG. 7, the bezel 2200 surrounds a lens 2400. The lens 2400 may be configured for internal reflectance and therefore may be a total internal reflectance (TIR) lens. The lens 2400 may resemble a substantially unitary member formed of a transparent material, for example, an acrylic material, however, one skilled in the art would know of several materials which may be used to form the lens 2400. In the nonlimiting example of FIG. 7, the lens 2400 is shown having a first passage 2435 and a second passage 2440. At an end of the first passage 2435 the surface 2455 may be shaped to reflect light downward through the lens 2400. As such, the surface 2455 may be a reflective surface. An end of the second passage 2440 may have a surface 2460 shaped like a lens to direct light from the light source 2800 to the surface 2455. Thus, when the light source 2800 is generating light, some of the light may be directed from the surface 2460 to the surface 2455 where it is directed downward and outward of the lens 2400 as shown in FIG. 9. As one skilled in the art would recognize, the downward direction of light is possible because the downward facing beam has an angle less than a TIR angle. When installed in the flashlight 2000, the light may leave the flashlight 2000 via an aperture 2430 which may be in the body 2100, through an aperture in the bezel 2200 (which may not be necessary in embodiments where the bezel 2200 is made of a transparent material), and out a window 2310 of the shroud 2300 as shown in FIG. 10. As in the previous examples, a user may simply twist the shroud 2300 to move the window 2310 away from the apertures or gaps 2430 to either decrease the amount of light leaving through the window 2310 or to prevent the light from leaving the flashlight 2000 via the window 2310.

The lens 2400 may resemble a substantially solid truncated cone having sides 2410, a first end 2402 and a second end 2404. The sides 2410 may have any curvature. For example, the curvature may be, but is not required to be, parabolic, elliptical, hyperbolic, or aspherical. In the alternative, the sides sides 2410 may be comprised of a collection of flat plates (planes) or circular segments which reflect light towards the second end 2404 of the lens 2400. The first end 2402 of the lens 2400 may be arranged near the light source 2800 whereas the second end 2404 may be arranged near an end of the flash light 2000. The lens 2400 may be configured to direct light from the light source 2800 out of the second end 2404 of the lens 2400 so the light may leave the flashlight 1000 via a first window 2950 which may be comprised of a transparent material, such as plastic or glass. The first window 2950 may, for example, resemble a transparent plastic or glass disc.

Referring to FIGS. 7 and 10, the first window 2950 may include, but is not required to include, a stub 2960 (shown in the embodiment of FIG. 10, but not in the embodiment of FIG. 7). The stub 2960 may be formed integrally with the first window 2950 or may be separately formed and then attached to the first window 2950. The stub 2960 may serve as an attachment structure for the lens 2400.

In example embodiments, the surface 2455 may be a reflective surface, or a TIR surface due to the angle it presents the rays from the source, which may be inclined, flat, or curved. For example, in one nonlimiting example embodiment, the surface 2455 may resemble a concave surface configured to direct light from the light source 2800 through the aperture 2430 or gap of the body 2100. As another example, the surface 2455 may simply be an inclined surface configured to direct light from the light source 2800 through the aperture 2430 or gap. The placement of the reflective surface 2455 may be at or near a centerline of the lens 2400. As such, the reflective surface 2455 may not significantly diminish the beam intensity of the flashlight leaving the second window 2950. That is, light coming directly off the light source 2800, which would be stray light, would be concentrated into a beam and deflected through the aperture 2430 or gap of the body 2100.

Figure 12A:
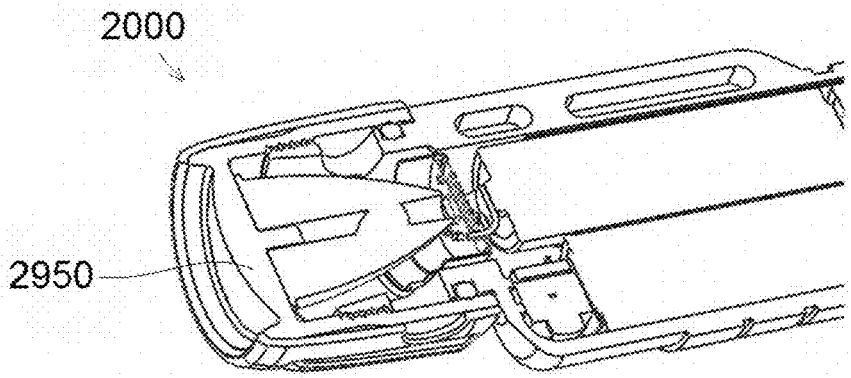
FIG. 12A is a close-up cross-section view of an end of a flashlight in accordance with example embodiments.
Figure 12B:
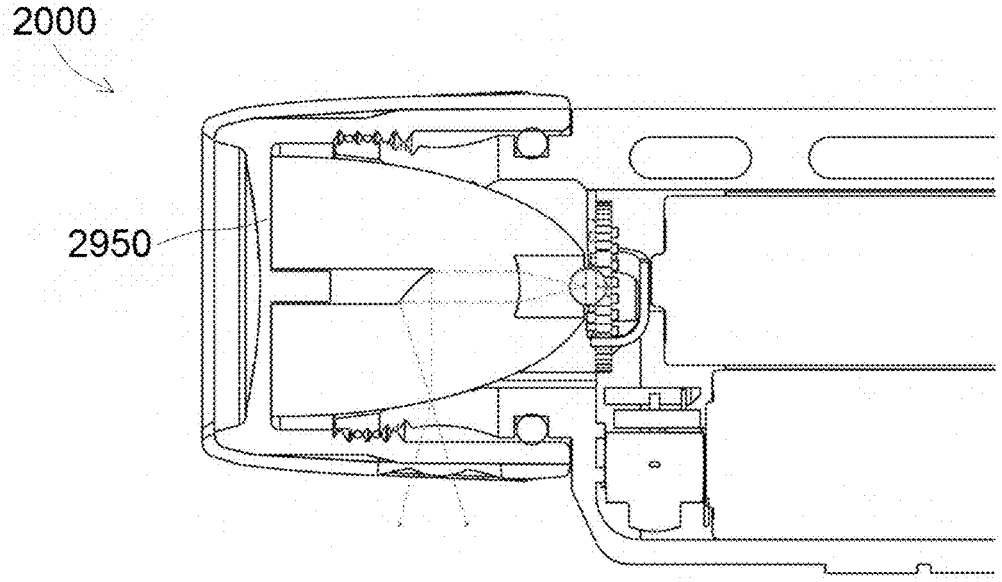
FIG. 12B is a close-up cross-section view of an end of a flashlight in accordance with example embodiments.

In example embodiments, the window 2950 may be substantially flat as shown in FIGS. 7 and 10, however, this is not intended to limit the invention. For example, the window 2950, as shown in FIGS. 12A and 12B, may be curved to help align light passing through the lens 2400. Thus, the window 2950, for example, may have a convex shape, concave surface, or flat surface, rather a flat shape as shown in FIGS. 7 and 10.

In example embodiments, the surfaces of the window 2950 may bend light so that light leaving the end of the flashlight may be substantially parallel. Ideally, with a parabolic lens, the surface of the window 2950 (or 950 for that matter), may be flat, however, as the sides 2410 depart from a parabolic shape (for example, to a hyperbolic or elliptical shape), the light leaving the second end 2404 of the lens 2400 may be slightly converging or diverging. This problem may be corrected by curving the window 2950. For example, if the light leaving the second end 2404 of the lens 2400 is slightly diverging, a window 2950 having a convex shape, like that of FIG. 12A, may align the light so the light leaving the window 2950 is substantially parallel. On the otherhand, if the light leaving the second end 2404 of the lens 2400 is slightly converging, a window having a concave shape like that of FIG. 12B may align the light so that the light leaving the window 2950 is substantially parallel.

Figure 13:
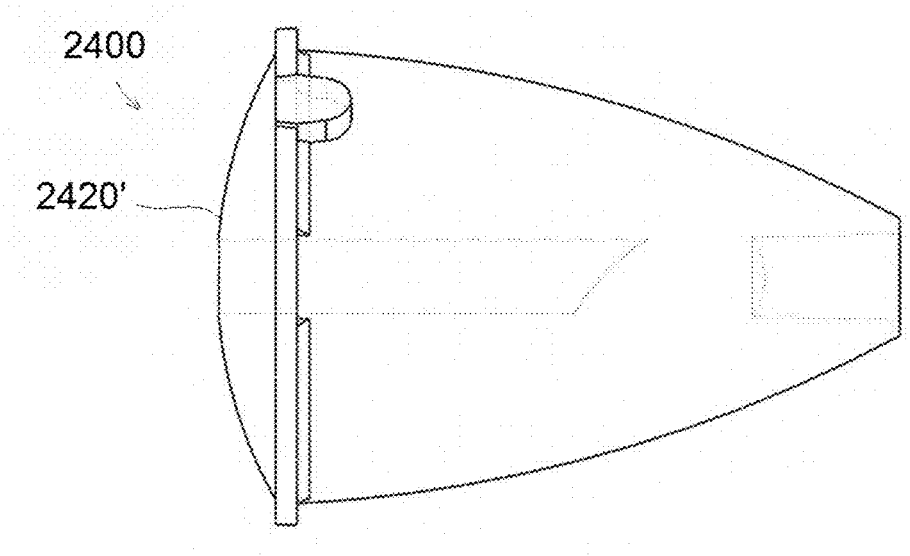
FIG. 13 is a view of a lens in accordance with example embodiments.
Figure 14:
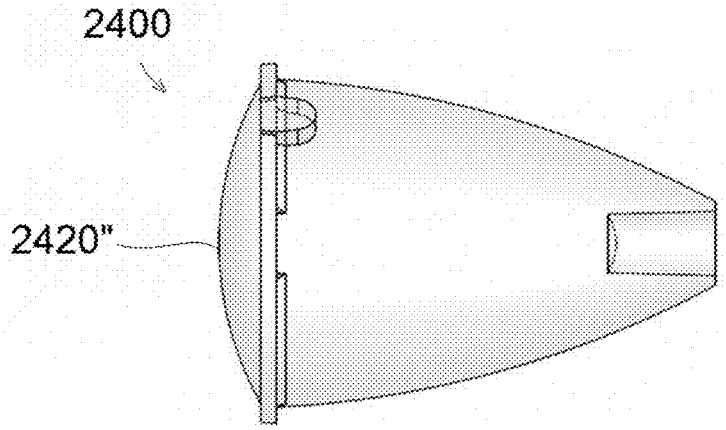
FIG. 14 is a view of a lens in accordance with example embodiments.

In example embodiments, the lens 2400 is illustrated as having a relatively flat side 2420 which may attach to the window 2950 via a stub or may simply be attached to the lens 2400 using an adhesive. However, various modifications of the lens 2400 are considered to fall within the inventive concepts of this application. For example, as shown in FIG. 13, the lens 2400 may have a curved side 2420' rather than a flat side 2420 as shown in FIG. 9. In this latter embodiment, the curved side 2420' may help align light reflected by the lens 2400. Of course, as one skilled in the art would readily appreciate, the surface 2420' rather than being curved outward may, alternatively, be curved inward to align light. As yet another example, the lens 2400 may be formed without a first passage 2435 as shown in FIG. 14. Although this latter embodiment may not have the advantage of producing a downlight, the concave surface 2420" (or alternatively, convex surface) may allow for greater light alignment compared to the traditional art.

The foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that which falls within the scope of the claims.

What is claimed is:

1. A flashlight comprised of:
a light source;
a first window configured to allow light generated from the light source to leave the flashlight in a first direction;
a second window configured to allow light generated from the light source to leave the flashlight in a second direction;
a first reflector configured to reflect the light out of the first window, the reflector including an aperture along a sidewall thereof; and
a reflective surface configured to reflect a portion of the light through the aperture of the reflector.

2. The flashlight of claim 1, wherein the first window is larger than the second window.

3. The flashlight of claim 1, further comprising:
a shroud, wherein the second window is in the shroud.

4. The flashlight of claim 1, wherein the reflective surface is arranged substantially at the centerline of the reflector.

5. The flashlight of claim 4, wherein the light source is arranged to emit light to the first reflector and stray light which does not contact the first reflector and the reflective surface is arranged to receive the stray light.

6. The flashlight of claim 1, further comprising:
a bezel surrounding the reflector.

7. The flashlight of claim 6, further comprising:
a shroud configured to surround the bezel, the shroud including the second window to allow light to leave the flashlight.

8. The flashlight of claim 7, further comprising:
a body attached to the bezel, wherein the shroud is configured so a user may turn the shroud to allow the user to misalign the second window with and an aperture in the body to prevent light from leaving the flashlight.

9. The flashlight of claim 8, wherein the aperture of the body is arranged to receive light from the reflective surface and the shroud is configured so a user may turn the shroud to allow the user to misalign the second window with the aperture of the body to prevent light from leaving the flashlight via the second window.

10. The flashlight of claim 1, wherein the reflective surface is connected to a structure that extends from the first window of the flashlight.

11. The flashlight of claim 1, wherein the reflective surface is part of a TIR lens.

12. The flashlight of claim 11, wherein the reflective surface is arranged along a centerline of the TIR lens.

13. The flashlight of claim 1, wherein the first window has a convex surface.

14. The flashlight of claim 1, further comprising:
a TIR lens having a curved outer surface configured to align light.

15. The flashlight of claim 14, wherein the curved outer surface is one of convex and concave.

16. The flashlight of claim 1, further comprising:
a TIR lens bonded to the first window so the first window and the TIR lens are rotationally fixed to one another.

17. A flashlight comprised of:
a light source;

a first window configured to allow light generated from the light source to leave the flashlight in a first direction;

a second window configured to allow light generated from the light source to leave the flashlight in a second direction, a reflective surface configured to reflect a portion of the light generated by the light source through the second window, wherein the reflective surface is part of a TIR lens, the first window is larger than the second window, the reflective surface is arranged along a centerline of the TIR lens, and the TIR lens includes a first channel terminating in a surface configured to direct light to the reflective surface.

18. The flashlight of claim 17, wherein the TIR lens includes a second channel terminating at the reflective surface.

19. A flashlight comprising:

a body having at least one aperture formed therein;

a light source configured to emit light;

a bezel having a first window to allow a portion of the light to leave the flashlight in a first direction;

a shroud having an aperture; and a reflective surface configured to reflect a portion of the light to the aperture of the shroud, wherein the shroud is rotationally attached to the body so that the aperture of the shroud and the at least one aperture in the body can be aligned to allow light to leave through the aperture of the shroud and misaligned to prevent light from passing through the aperture of the shroud.

* * * * *